US008527097B2

(12) United States Patent
Komiya et al.

(10) Patent No.: US 8,527,097 B2
(45) Date of Patent: Sep. 3, 2013

(54) AIR CONDITIONING MANAGEMENT APPARATUS, AIR CONDITIONING MANAGEMENT METHOD, AIR CONDITIONING SYSTEM, PROGRAM, AND RECORDING MEDIUM

(75) Inventors: Noriyuki Komiya, Tokyo (JP); Taichi Ishizaka, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 409 days.

(21) Appl. No.: 12/811,654

(22) PCT Filed: Jan. 27, 2009

(86) PCT No.: PCT/JP2009/051230

§ 371 (c)(1),
(2), (4) Date: Jul. 2, 2010

(87) PCT Pub. No.: WO2009/119150

PCT Pub. Date: Oct. 1, 2009

(65) Prior Publication Data

US 2010/0292860 A1 Nov. 18, 2010

(30) Foreign Application Priority Data

Mar. 27, 2008 (JP) ..... 2008-082703

(51) Int. Cl.
*G05B 13/00* (2006.01)

(52) U.S. Cl.
USPC ..... 700/276; 700/278; 700/295

(58) Field of Classification Search
USPC ..... 700/276–278, 295, 300
See application file for complete search history.

(56) References Cited

U.S. PATENT DOCUMENTS

| | | | | |
|---|---|---|---|---|
| 5,689,963 | A * | 11/1997 | Bahel et al. | 62/129 |
| 2005/0096797 | A1* | 5/2005 | Matsubara et al. | 700/291 |
| 2006/0036349 | A1* | 2/2006 | Kates | 700/276 |
| 2007/0043477 | A1* | 2/2007 | Ehlers et al. | 700/276 |

FOREIGN PATENT DOCUMENTS

| | | | |
|---|---|---|---|
| JP | 11-316056 | A | 11/1999 |
| JP | 2001-99472 | A | 4/2001 |
| JP | 2001-327076 | A | 11/2001 |
| JP | 2002-22248 | A | 1/2002 |
| JP | 2004-324985 | A | 11/2004 |
| JP | 2006-97941 | A | 4/2006 |

OTHER PUBLICATIONS

International Search Report (PCT/ISA/210) dated Apr. 7, 2009.
Office Action (Notification of Reasons for Refusal) dated Apr. 17, 2012, issued in corresponding Japanese Patent Application No. 2010-505418, and an English Translation thereof. (5 pages).
Office Action from the Chinese Patent Office dated Sep. 24, 2012, issued in corresponding Chinese Patent Application No. 200980104963.3, with an English translation thereof.
Office Action from Chinese Patent Office dated Feb. 16, 2013, issued in corresponding Chinese Patent Application No. 200980104963.3, with English translation thereof.

* cited by examiner

*Primary Examiner* — Sean Shechtman
(74) *Attorney, Agent, or Firm* — Buchanan Ingersoll & Rooney PC

(57) ABSTRACT

An air conditioning management apparatus has a measured value acquisition portion for obtaining measured values of the state of air conditioning equipment and an air-conditioned state, a law/regulation information acquisition portion for obtaining law/regulation information through a network, an equipment control portion for determining a control method of the air conditioning equipment to realize energy saving from the measured values and law/regulation information and controlling the air conditioning equipment, an adding/changing portion for measured value acquisition portion for adding/changing an object to be measured and a measurement method, through the network or by an input by the user, and an adding/changing portion for equipment control portion for adding/changing a determination method of an air conditioning equipment control method and a method of executing the control of the air conditioning equipment, through the network.

17 Claims, 5 Drawing Sheets

AIR CONDITIONING MANAGEMENT APPARATUS, AIR CONDITIONING MANAGEMENT METHOD, AIR CONDITIONING SYSTEM, PROGRAM, AND RECORDING MEDIUM

TECHNICAL FIELD

The present invention relates to an air conditioning management apparatus for operating and monitoring air conditioning equipment, an air conditioning management method, an air conditioning system, a program for causing a computer to execute them, and a recording medium to which the program is stored.

BACKGROUND ART

Conventionally, it has been already realized to manage an electricity rate and to perform an energy saving control by controlling an amount of used power and maximum power in a power load based on a target value set by a user. There is proposed "an electricity rate management apparatus having a means for setting a target value of an amount of power used by a power load in a predetermined period, a means for accumulating the value of an amount of power used by the power load in a unit time obtained by minutely dividing the predetermined period, a means for calculating a target value of the amount of power used in each unit time based on the target value of the amount of power used in the predetermined period and the amount of power used in each unit time, and a means for controlling the amount of power used by the power load based on the target value of the calculated amount of power used in each unit time" (refer to, for example, Patent Document 1) as a technology having an object of providing, for example, "an electricity rate management apparatus which can manage an electricity rate by setting a target value to an electricity rate, to an amount of power used by all the power loads or to $CO_2$ in a facility in a predetermined period such as a unit of one month or one year and controlling an amount of used power and maximum power in the electric loads based on the target".

Patent Document 1 Japanese Patent Application Laid-Open Publication No. 2001-327076 ([0006], [0009], FIG. 1.

DISCLOSURE OF THE INVENTION

Problems to be Solved by the Invention

In an air conditioning management apparatus for performing operating and monitoring air conditioning equipment, when a law and a regulation, which are one of sources of the target value set by the user, are in the course of preparation, a target to be achieved is changed according to the progress of preparation of them or the items to be measured and a method of controlling equipment, which are necessary to achieves the target, are changed. However, Patent Document 1 and any other devices cannot realize an energy saving control following to the law and the regulation which are in the course of preparation in conformity with state of society at that time. Accordingly, a problem arises in that an air conditioning management apparatus must be updated according to an updated low and regulation and an expensive cost and a large man-hour are required thereby.

A first object of the present invention, which was made to solve the above object, is to provide an air conditioning management apparatus, an air conditioning management method, and an air conditioning system capable of timely realizing an energy saving control, which flexibly copes with a law and a regulation in the course of preparation and with a time-sequentially changing target value of a user, at a low cost with a small man-hour, and a second object of the present invention is to provide a program for realizing the respective processes of the air conditioning management apparatus by a computer and a recording medium in which the program is stored.

Means for Solving the Problems

An air conditioning management apparatus according to the present invention has a measured value acquisition means for obtaining the measured value of at least one of the state of air conditioning equipment and an air-conditioned state, a law/regulation information acquisition means for obtaining law/regulation information through a network or by an input of a user, an equipment control means for determining a control method of the air conditioning equipment for realizing energy saving based on the measured value and the law/regulation information and controlling the air conditioning equipment, an adding/changing means for measured value acquisition means for adding/changing a subject to be measured and a measurement method of the measured value acquisition means through the network or by an input of the user, and an adding/changing means for equipment control means for adding/changing a determination method of an air conditioning equipment control method of the equipment control means and a method of executing the control of the air conditioning equipment through the network or by an input of the user.

Advantages of the Invention

According to the air conditioning management apparatus of the present invention, there are provided the measured value acquisition means, the law/regulation information acquisition means, the equipment control means, the adding/changing means for measured value acquisition means, and the adding/changing means for equipment control means. As a result, since a subject to be measured and a measurement method can be changed and an equipment control method can be changed while flexibly coping with, for example, a law and a regulation which are in the course of preparation and are updated as necessary and with the target value set by a user, an energy saving control can be realized at a low cost with a small man-hour.

EXPLANATION OF REFERENCE NUMERALS

100 air conditioning management apparatus, 101 law/regulation information acquisition means, 102 measured value acquisition means, 103 adding/changing means for measured value acquisition means, 104 equipment control means, 105 adding/changing means for equipment control means, 106 server, 107 setting device, 108 external network, 109 air conditioner, 110 advice presentation means, 111 adding/changing means for advice presentation means, 112 selection means, 113 target value setting means, 700 air conditioning management apparatus, 701 outdoor unit, 702 indoor unit A, 706 area A

BEST MODE FOR CARRYING OUT THE INVENTION

Embodiment 1

Figure 1:
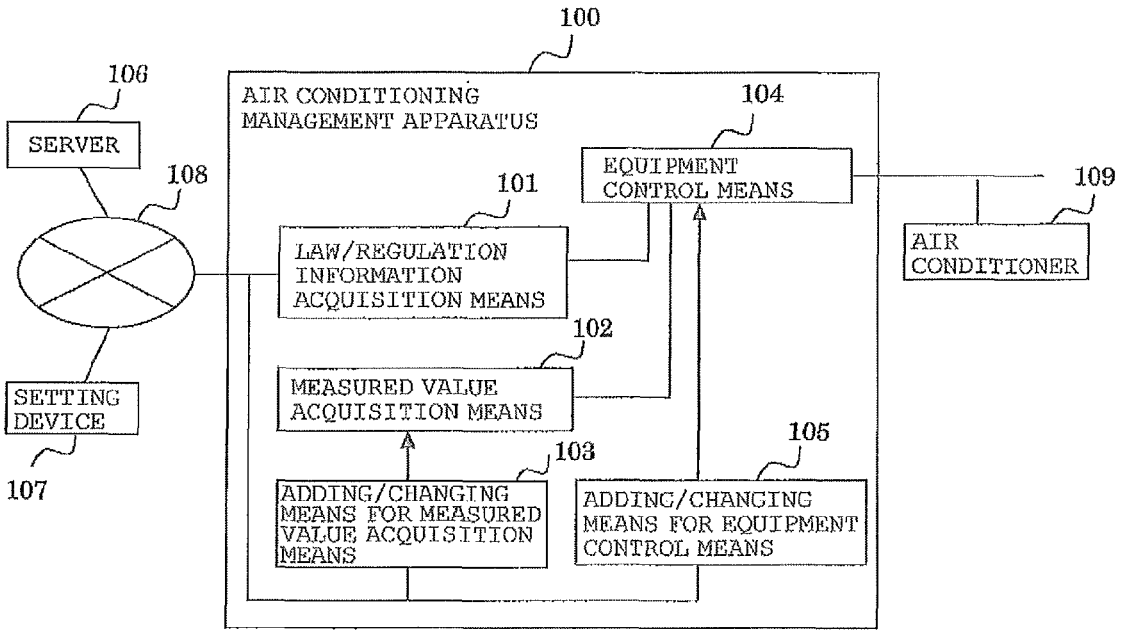
FIG. 1 is a view showing an example of a schematic arrangement of an air conditioning management apparatus according to an embodiment 1 of the present invention.

FIG. 1 shows an example of a schematic arrangement of an air conditioning management apparatus according to an embodiment 1 of the present invention. The air conditioning management apparatus 100 has a law/regulation information acquisition means 101, a measured value acquisition means 102, an adding/changing means for measured value acquisition means 103, an equipment control means 104, and an adding/changing means for equipment control means 105, and these means are realized by, for example, a microcomputer, a memory, and a software program executed on the memory. This is the same in modifications of the embodiment described later.

The law/regulation information acquisition means 101 is connected to an external network 108 such as the Internet and the like and obtains law/regulation information from a server 106 through the external network 108. When a user sets, for example, URL of the server 106, in which target information exists, and acquisition intervals of the target information to the law/regulation information acquisition means 101 by a setting device 107 connected to the external network 108, the law/regulation information acquisition means 101 obtains law/regulation information from the predetermined server 106 at predetermined time intervals (for example, once a month and the like) according to the setting, analyzes provisions, and extracts a control target value. Methods of, for example, syntax analysis, keyword detection, extraction of numerical values from fixed phrases, and the like can be used to analyze the provisions.

A subject to be measured and a measurement method of the measured value acquisition means 102 are set by the adding/changing means for the measured value acquisition means 103. The adding/changing means for the measured value acquisition means 103 is connected to the external network 108, and the user can set the subject to be measured and the measurement method by the setting device 107. The measured value acquisition means 102 measures the state of air conditioning equipment and an air conditioned state, for example, a room temperature, an outside air temperature, an indoor humidity, an outdoor humidity, power consumption (instant power, an amount of power consumption, trends thereof, and the like), a COP value, an amount of leaked refrigerant, and the like according to the set subject to be measured and the set measurement method.

The equipment control means 104 determines a method of controlling the air conditioning equipment based on the information such as a control target value, a measured value, and the like obtained from the law/regulation information acquisition means 101 and the measured value acquisition means 102 and executes an actual control. When there is a control target value for keeping, for example, "a state that a room temperature is 4° C. lower than an outside air temperature in an cooling operation", a control is executed such that when a result of measurement of a present outside air temperature is 33° C. and a result of measurement of a room temperature is 32° C., the cooling operation is performed more intensely, when a result of measurement of the room temperature is 30° C., the cooling operation is performed less intensely, and thereafter the cooling operation is kept until the room temperature gradually falls to 29° C. and turned off once when the room temperature falls to 28° C. or less, and a similar cooling operation is performed when the room temperature rises again. The equipment control means 104 stores a plurality of options for selecting "modes for controlling the air conditioning equipment such as a mode for performing a cooling operation more intensely, a mode for performing a cooling operation less intensely, and the like, and a plurality of control algorithms are also set as a superordinate concept of the options to determine that a control is to be performed using what option under what condition. When the respective control algorithms are executed, necessary measured values are obtained, a control method is selected referring to conditions, and an air conditioner 109 is actually controlled using an air conditioning equipment control command necessary to the control. The method (control algorithm) of determining how air conditioning equipment is controlled from a control a target value and a measured value and the method of executing an actual control (air conditioning equipment control command) ad described above can be optionally added and changed making use of the adding/changing means for equipment control means 105 in addition to that these methods are previously mounted on an air conditioning management apparatus when it is shipped. Information as to addition and change can be set to the adding/changing means for equipment control means 105 by the setting device 107 also in this case.

Note that, in the explanation of the embodiment, a mode, in which the law/regulation information acquisition means 101 is connected to the external network 108 and information is obtained from the server 106, is exemplified. However, the server 106 may be ordinarily a server to which laws and the like are inserted or may be a dedicated server prepared for the air conditioning management apparatus 100. Further, law/regulation information may be directly set by the setting device 107 without through the external network 108, or a main body of the air conditioning management apparatus 100 may be provided with a means through which the user can directly input necessary information. Further, the case that the setting device 107 is connected through the external network 108 typically represented by the Internet is exemplified as a method of connecting it. However, a serial, parallel or other dedicated communication connecting port may be disposed to a main body of an air conditioning management apparatus 100 and the setting device 107 may be connected through the communication connecting port or a means may be disposed to the main body of the air conditioning management apparatus 100 so that the user can directly make an input to the means. Further, subjects to be measured, a measurement method, a control method, and the like, which are required by the law/regulation information acquisition means 101, may be automatically set or selected from options by causing the law/regulation information acquisition means 101, the adding/changing means for measured value acquisition means 103, and the adding/changing means for equipment control means 105 to associate with each other. Further, as to the adding/changing means for measured value acquisition means 103 and the adding/changing means for equipment control means 105, the user may directly make an input without through the external network 108 likewise the law/regulation information acquisition means 101. This is also the same as to an adding/changing means for advice presentation means 111 (refer to FIG. 2) and a target value setting means 113 (refer to FIG. 4).

Further, the air conditioning management apparatus of the present invention is not limited to the arrangement of the air conditioning management apparatus of FIG. 1, and various modifications are considered. These modifications will be explained in FIGS. 2 to 6 to be described later.

Figure 2:
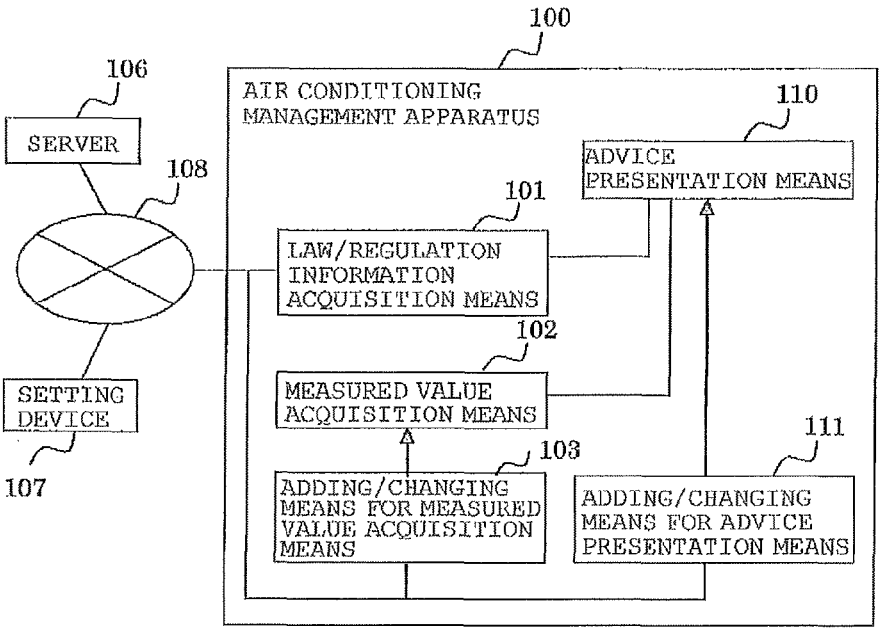
FIG. 2 is a view showing a schematic arrangement of an air conditioning management apparatus according to a modification of the embodiment 1.

FIG. 2 is a view showing a schematic arrangement of a modification (1) of the air conditioning management apparatus of FIG. 1.

The air conditioning management apparatus 100 has an advice presentation means 110 and an adding/changing means for advice presentation means 111 in place of the equipment control means 104 and the adding/changing means for equipment control means 105 of FIG. 1. Accordingly, the air conditioning management apparatus 100 does not control an air conditioner from the information of the law/regulation information acquisition means 101 and the measured value acquisition means 102 but presents an advice as to the operation of the air conditioner by the advice presentation means 110. When, for example, a law itself is in the course of preparation and information for controlling equipment is not sufficiently gathered because a means for obtaining a measured value is not matured yet, it is one method to present an advice as shown in FIG. 2. The user, who obtains the advice, can realize energy saving by performing an operation according to the advice. As a method of presenting the advice, a display device may be mounted on a main body of the air conditioning management apparatus 100 and the advice may be shown thereby or the advice may be received by other equipment (for example, a setting device and the like) through a network. Further, an advice contents creation method as to what type of an advice to be presented in what type of a state and an advice presentation method as to where and how an advice to be presented can be optionally added and changed making use of the adding/changing means for advice presentation means 111. Information as to addition and change can be set to the adding/changing means for advice presentation means 111 by the setting device 107 and the like also in this case.

Figure 3:
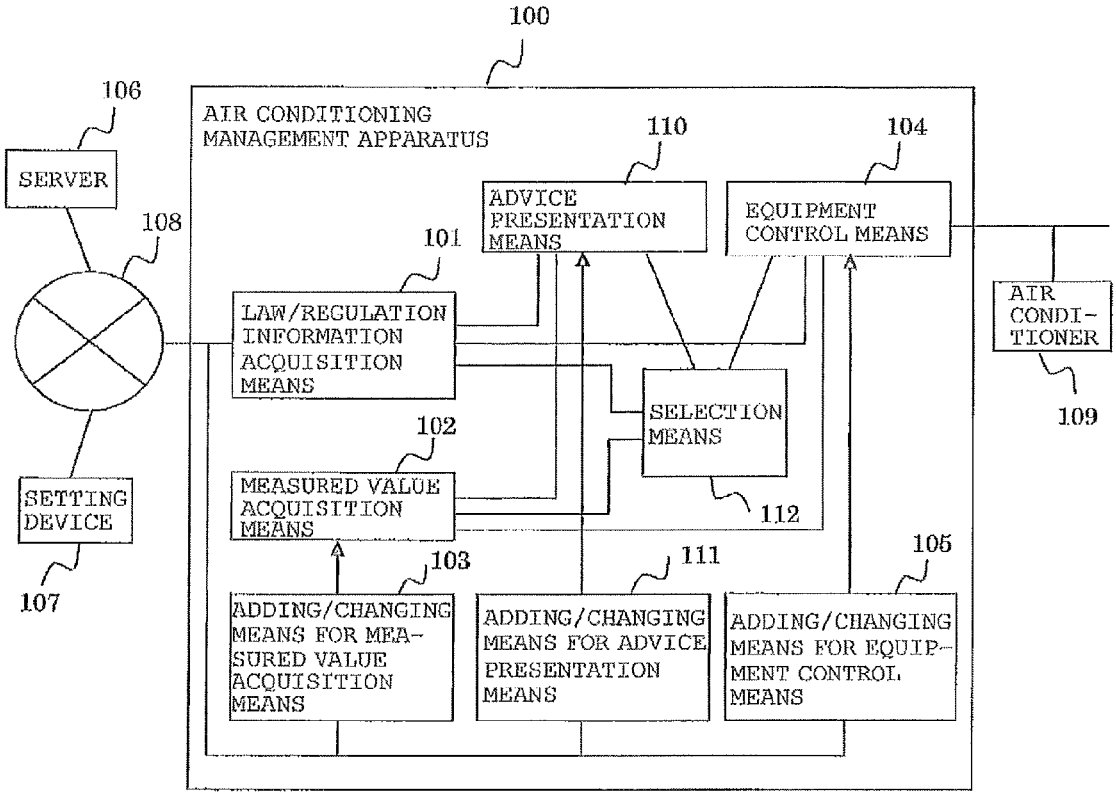
FIG. 3 is a view showing a schematic arrangement of an air conditioning management apparatus according to a modification of the embodiment 1.

FIG. 3 is a view showing a schematic arrangement of a modification (2) of the air conditioning management apparatuses of FIGS. 1 and 2.

An air conditioning management apparatus 100 can selectively use the equipment control means 104 of FIG. 1 and the advice presentation means 110 of FIG. 2 or can use both of them. The air conditioning management apparatus 100 has the equipment control means 104 and the adding/changing means for equipment control means 105 of FIG. 1 and the advice presentation means 110 and the adding/changing means for advice presentation means 111 of FIG. 2. The air conditioning management apparatus 100 further has an selection means 112 for determining whether any one or both of the equipment control means 104 and the advice presentation means 110 are used from the state of preparation of a law and a regulation, the state of preparation of a means for measurement, and the like. As a selection method performed by the selection means 112, there are contemplated a method of using the equipment control means 104 when all the measured values, which are required by a control algorithm, are prepared as shown in, for example, the above example, a method of using the advice presentation means 110 when all the measured values are not prepared, and the like. As described above, any one of the equipment control means 104 and the advice presentation means 110 may be used or both of them may be used at the same time. When both of them are used at the same time, an advice can be also obtained while controlling an air conditioner 109.

Figure 4:
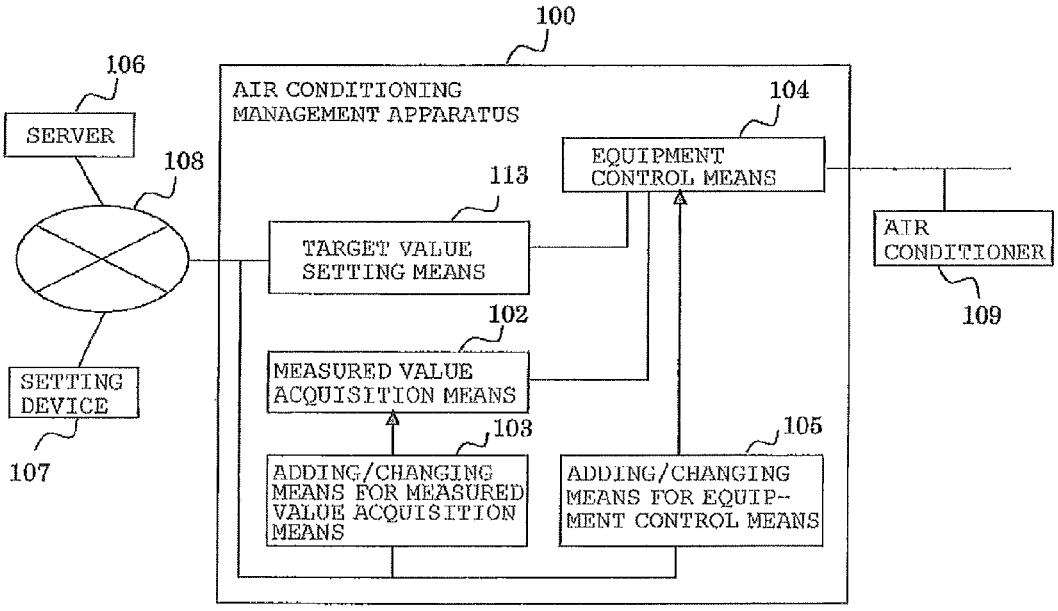
FIG. 4 is a view showing a schematic arrangement of an air conditioning management apparatus according to acquisition modification of the embodiment 1.

FIG. 4 is a view showing a schematic arrangement of a modification (3) of the air conditioning management apparatus of FIG. 1.

The air conditioning management apparatus 100 has a target value setting means 113 in place of the law/regulation information acquisition means 101 of FIG. 1. A user can directly set a target value to the target value setting means 113 making use of a setting device 107 or a user input means (not shown) disposed to a main body of the air conditioning management apparatus 100 likewise the case of the law/regulation information acquisition means 101. The other operations are the same as those of FIG. 1.

Figure 5:
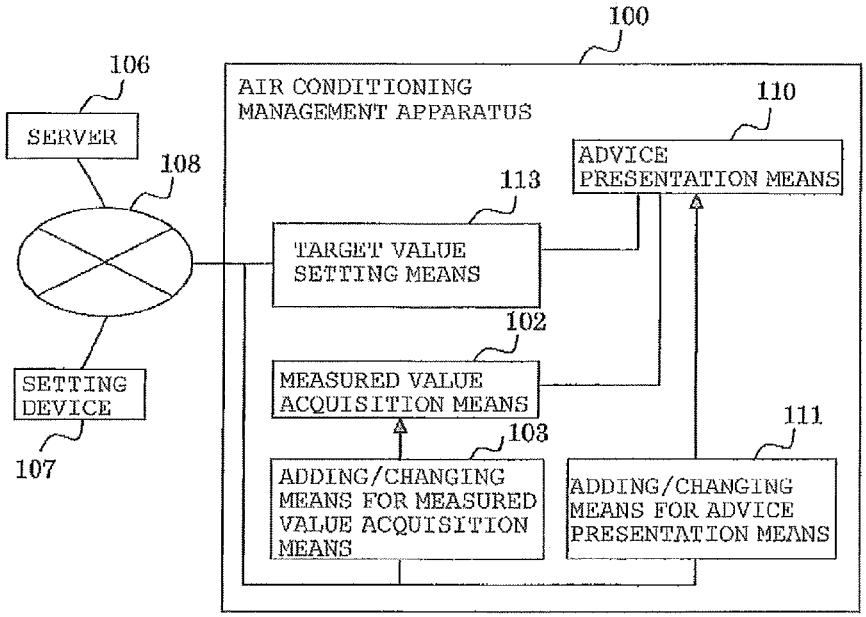
FIG. 5 is a view showing a schematic arrangement of an air conditioning management apparatus according to a modification of the embodiment 1.

FIG. 5 is a view showing a schematic arrangement of a modification (4) of the air conditioning management apparatus of FIG. 4.

The air conditioning management apparatus 100 has an advice presentation means 110 and an adding/changing means for advice presentation means 111 in place of the equipment control means 104 and the adding/changing means for equipment control means 105 of FIG. 4.

Figure 6:
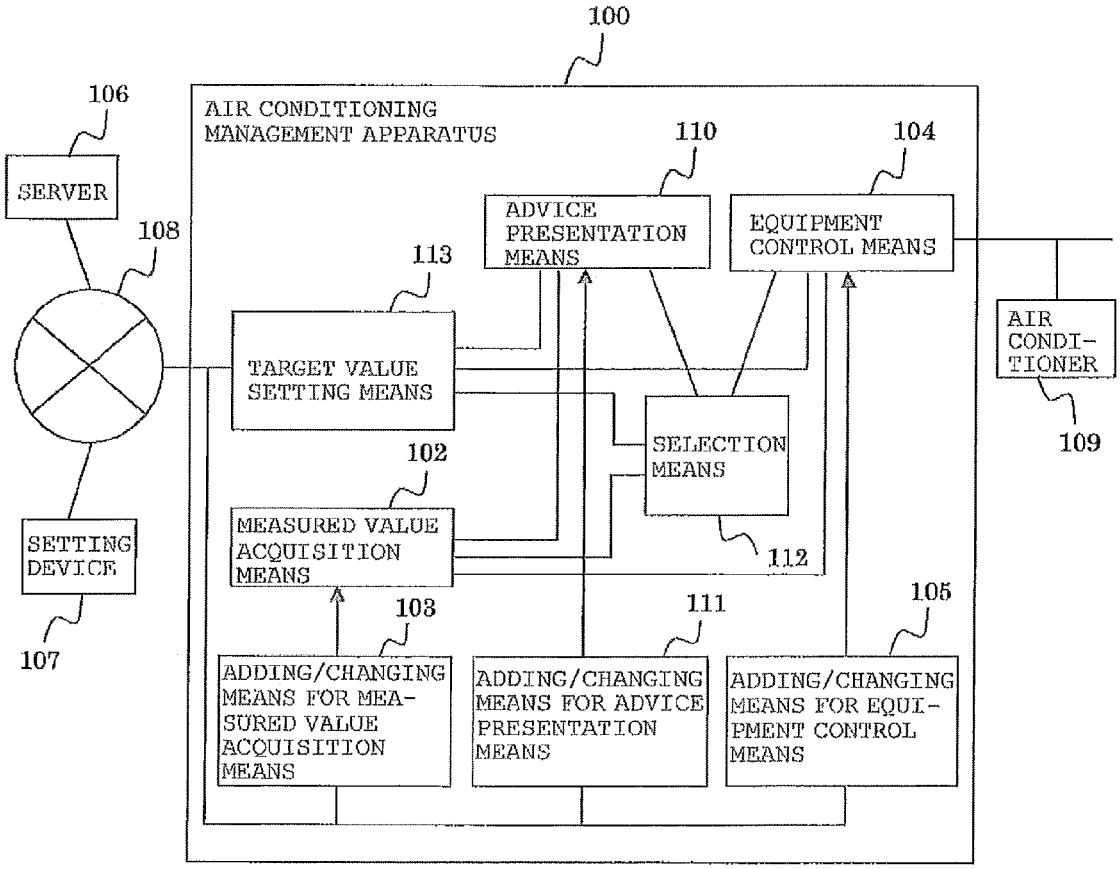
FIG. 6 is a view showing a schematic arrangement of an air conditioning management apparatus according to a modification of the embodiment 1.

FIG. 6 is a view showing a schematic arrangement of a modification (5) of the air conditioning management apparatuses of FIGS. 4 and 5.

The air conditioning management apparatus 100 can selectively use any one or both of the equipment control means 104 of FIG. 4 and the advice presentation means 110 of FIG. 5. The air conditioning management apparatus 100 has the equipment control means 104 and the adding/changing means for equipment control means 105 of FIG. 4 and the advice presentation means 110 and the adding/changing means for advice presentation means 111 of FIG. 5. The air conditioning management apparatus 100 further has a selection means 112 for using any one or both of the equipment control means 104 and the advice presentation means 110.

The operations of the air conditioning management apparatuses of FIGS. 5 and 6 correspond to those of the air conditioning management apparatuses of FIGS. 2 and 3 except a target value setting operation making use of the target value setting means 113. In the air conditioning management apparatuses of FIGS. 5 and 6, an equipment control is performed or an advice is presented to realize a target value set by a user.

Incidentally, when the various setting means (law/regulation information acquisition means 101, target value setting means 113) and the adding/changing means (adding/changing means for measured value acquisition means 103, adding/changing means for equipment control means 105, adding/changing means for advice presentation means 111) can be freely used by any user, caution must be paid to a danger in that a malicious user makes an addition and a change which are inconvenient to an apparatus and a system. To cope with the above circumstance, it must be confirmed using a function of user authentication and the like that whether a user is authorized to make use of, for example, various setting, adding, and changing means before the user uses them.

As described above, according to the air conditioning management apparatuses of the embodiment, a subject to be measured, a measurement method, an equipment control method, an advice method, and the like can be appropriately changed in consideration of a law and a regulation which are in the course of preparation and a target value set by a user with flexibility. As a result, a energy saving control can be realized by at a low cost in a smaller man-hour.

Embodiment 2

Figure 7:
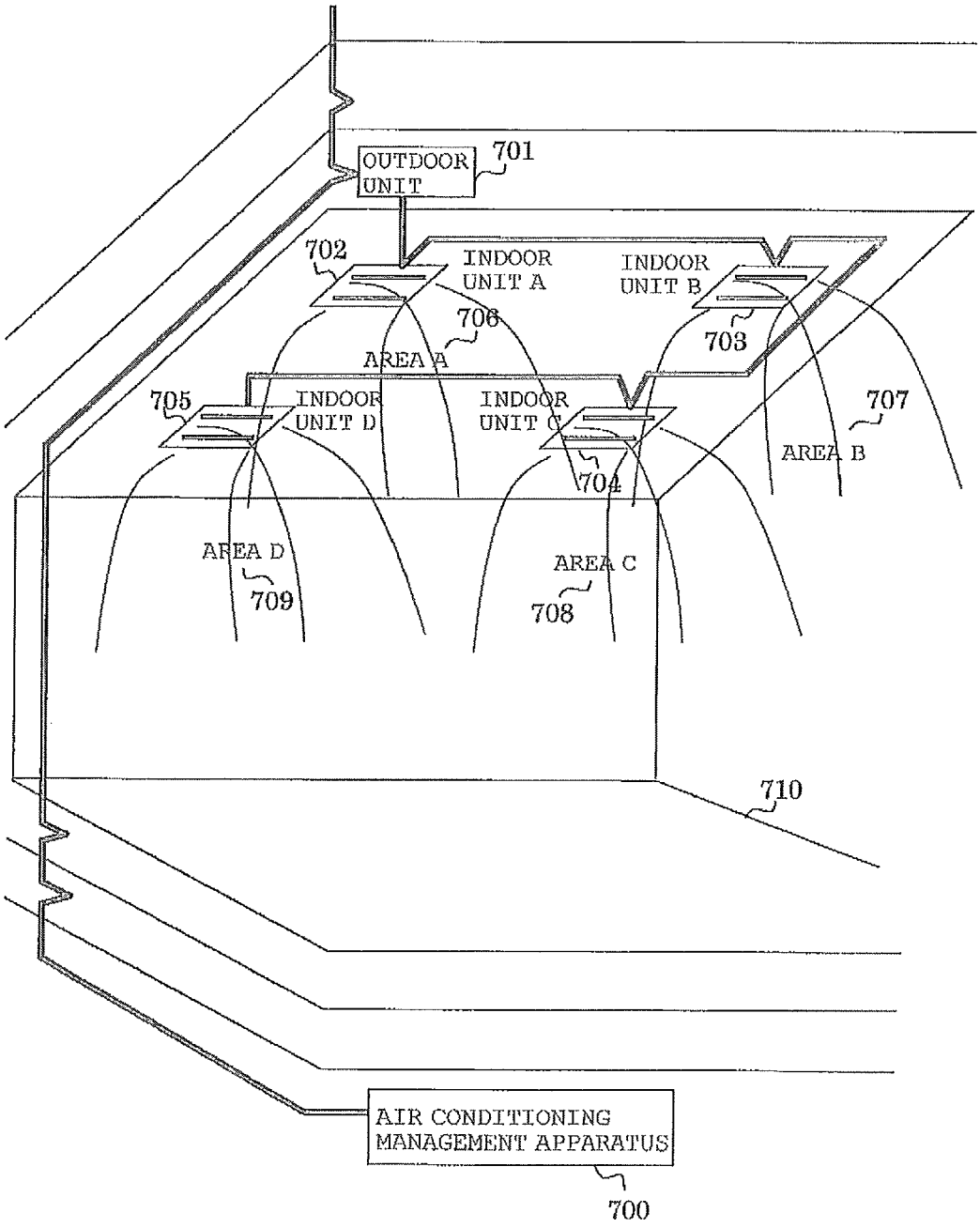
FIG. 7 is a view showing a schematic arrangement of an air conditioning system according to an embodiment 2 of the present invention.

FIG. 7 shows an example of a schematic arrangement of an air conditioning system according to an embodiment 2 of the present invention.

FIG. 7 schematically illustrates how an air conditioning management apparatus 700, an air conditioner outdoor unit 701, air conditioner indoor units 702 to 705 are installed and connected on a floor 710 in a building in which an air conditioner is installed. Further, it is assumed that the air conditioner outdoor unit is simply referred to as an outdoor unit, the air conditioner indoor unit is referred to as an indoor unit, and the outdoor unit and the indoor unit are generically referred to as an air conditioner, respectively. The air conditioning management apparatus 700 is connected to the outdoor unit 701 and the indoor units 702 to 705 of the air conditioner. As shown in the example of the drawing, a plurality of indoor units are ordinarily connected to one outdoor unit in this type of an air conditioning system. Note that it is assumed that the air conditioning management apparatus 700 is composed of the air conditioning management apparatus 100 described in any of FIGS. 1 to 6.

The air conditioning management apparatus 700 controls the operations of the outdoor unit 701 and the indoor units A 702 to D 705, and a room is entirely cooled by that these operations are affected each other. In the above operations, it is assumed that a space region, which is most strongly affected by the indoor unit A 702 is called an area A 706, a space region, which is most strongly affected by the indoor unit B 703 is called an area B 707, a space region, which is most strongly affected by the indoor unit C 704 is called an area C 708, and a space region, which is most strongly affected by the indoor unit D 705 is called an area D 709. Here, it is assumed that an equipment control means 104 of the air conditioning management apparatus 700 performs a thermo OFF control to each of the outdoor unit 701 and the indoor units A 702 to D 705. When a target value is instructed by a law, a regulation, and the like or when a target value is set by a user to energy saving of, for example, 6%, 8%, a thermo OFF is changed by a unit of, for example, 1% from 0% to 100% and adjusted while it is being measured. When it is required to reduce, for example, an amount of power consumption as the contents of "energy saving", the amount of power consumption is measured by a measured value acquisition means 102 while performing the thermo OFF control, and a control is performed so that the amount of power consumption is lowered to a required level. When the thermo OFF is controlled in a minute unit as in the example in addition to that it is controlled only to 0% or 100%, an appropriate control can be realized so that the target value is achieved and comfortability is not sacrificed by an excessive control beyond the target.

Further, when the thermo OFF control is performed on the outdoor unit 701 side, a communication traffic for controlling the air conditioner can be more suppressed while keeping a uniform air-conditioned state of target spaces. When the control is performed on the outdoor unit 701 side, since the same advantage as that all the indoor units 702 to 705 connected to the outdoor unit 701 are subjected to the same control, a uniform air-conditioned state can be kept to the target spaces. However, when the control is performed on the indoor units A 702 to D 705 side, there is a possibility that the uniform air-conditioned state cannot be kept unless the respective target spaces are subjected to the same control by all the indoor units A 702 to D 705 which perform air conditioning of the target spaces. When it is assumed, for example, that only the indoor unit A702 is subjected to a 50% thermo OFF control and the other indoor units are not subjected to the thermo OFF control, there is a possibility that "a feeling of somehow hot" occurs in the vicinity of the area A 706, which is the space region most strongly affected by the indoor unit A 702 when the vicinity of the area A 706 is compared with the periphery of the area A 706 (when cooling is performed). Although it is necessary to individually supply control commands to the respective indoor units and to perform the same control thereto to prevent occurrence of the above circumstance, the communication traffic is increased to control the air conditioner. However, when the control is performed on the outdoor unit 701 side, since it is sufficient to supply a control command only to the outdoor unit 701, the communication traffic can be more suppressed than the case in which the control commands are supplied to the individual indoor units A 702 to B 705.

The control for performing thermo OFF and thermo ON starts and stops a compressor depending on a method of performing the control. As a result, since a load is applied to the outdoor unit, reliability is deteriorated and a life of equipment is shortened. Accordingly, it is effective to perform the thermo OFF control in such a manner that when an operation is started once, at least one indoor unit is placed in a slightly operating state so that the outdoor unit is not placed in a 100% thermo OFF state in place that all the indoor units are stopped and the outdoor unit is placed in the 100% thermo OFF state. With this operation, the life of air conditioning equipment can be prolonged by suppressing aged deterioration thereof.

Further, the reliability of the outdoor unit is deteriorated and the life thereof is shortened by the thermo OFF/thermo ON control as described above. Thus, when the number of times of control is counted and stored and the counted number exceeds a predetermined number, warning is issued to show that deterioration of the air conditioner is predicted and that it is recommended to request a service of a maker to check the air conditioner. This will be explained in detail using FIG. 8.

Figure 8:
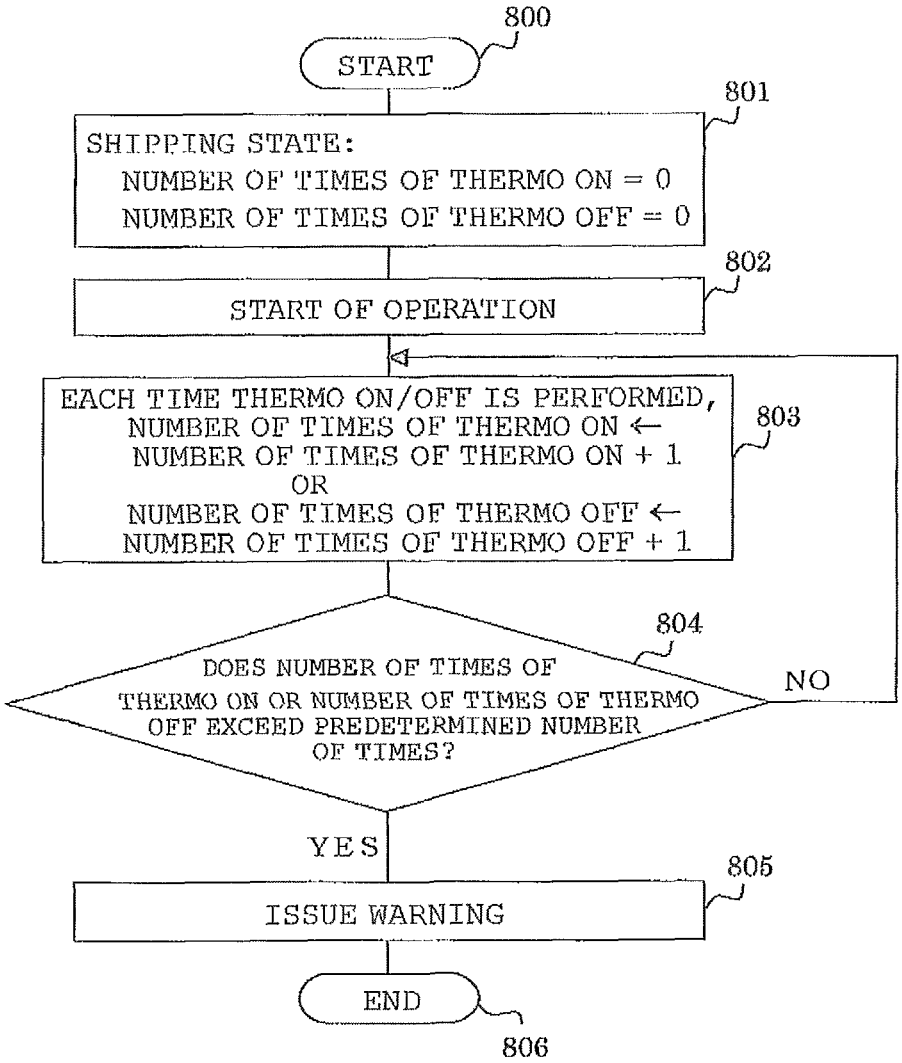
FIG. 8 is a flowchart showing an example of a procedure for generating a warning based on a prediction of aged deterioration of the air conditioning system according to the embodiment 2.

FIG. 8 shows an example of a procedure for issuing warning based on a prediction of aged deterioration of the air conditioning management apparatus according to the embodiment 2. As shown in FIG. 8, for example, both the number of times of thermo ON and the number of times of thermo OFF are stored as 0 in a shipping state (step 801), and each time a thermo ON control or a thermo OFF control is performed after an operation is started (step 802), the numbers of times of the respective controls are counted up and stored (step 803). It is determined whether or not the number of times of the thermo ON or the thermo OFF exceeds the predetermined number of times during the operation (step 804), and when it does not exceed the predetermined number of times, nothing is particularly performed, whereas when it exceeds the predetermined number of times, warning is issued (step 805). When the warning is issued, the air conditioner is checked by, for example, the service of the maker and maintenance is performed thereto. When deteriorated parts are replaced, the number of times of the thermo ON or the thermo OFF is reset to 0 likewise the shipping state, and a sequence from the start of operation of FIG. 8 (step 802) is performed again. As a result of the check, when no parts are replaced and old parts are continuously used, a predetermined number of times of the thermo ON or the thermo OFF is set again to issue warning next time, and the sequence from the start of operation of FIG. 8 (step 802) is also performed. The warning may be displayed on a display device mounted on a main body of the air conditioning management apparatus 700 or may be received by other equipment (for example, setting device and the like) through a network. Further, information for requesting a check may be directly transmitted to the service of the maker through the network. With this arrangement, a failure or an accident due to aged deterioration can be prevented before it occurs.

As a control method of saving energy of equipment, a COP value (score coefficient=refrigeration capability (kW)/output (kW) of motor for driving compressor) can be also used. For example, the COP value measured and calculated by the outdoor unit 701 is obtained and stored by the measured value acquisition means 102 of the air conditioning management apparatus 700 whenever it is necessary. The equipment control means 104 monitors the COP value, and the number of revolutions of a compressor is stored when the COP value is maximized. Thereafter, when air conditioner is controlled so that the number of revolutions is set to an upper limit number of revolutions, the air conditioner is prevented from being inefficiently operated by uselessly consuming power, thereby energy saving can be realized. Since the timing at which the COP value is maximized is varied depending on the number of indoor units subjected to the thermo ON and the characteristics of a space in which they are installed, it is effective to perform the dynamic control accompanied with the measurement.

As described above, according to the air conditioning management apparatus of the embodiment, since the thermo ON and thermo OFF controls are performed minutely, an air conditioning control for achieving a target of energy saving and the like can be realized while keeping air conditioning comfortability and suppressing a communication traffic. The life of equipment can be prolonged and a failure and an accident due to aged deterioration can be prevented before they occur. Further, an energy saving operation can be realized by obtaining and using the COP value.

The air conditioning management apparatus has been mainly explained up to now, this is the same as to an air conditioning system composed of at least one set of an air conditioning management apparatus and an at least one system of air conditioners connected to the air conditioning management apparatus as shown also in FIGS. 1, 3, 4, 6, and 7. Further, this is the same as to an air conditioning management method for realizing the air conditioning management apparatus and the air conditioning system. The functions of the air conditioning system and the air conditioning management method are realized by a microcomputer, a memory, and a software program and data stored to the memory and executed likewise the air conditioning management apparatus. The software program is installed on the air conditioning management apparatus 700 through, for example, The Internet or stored in a recording medium and directly installed to the air conditioning management apparatus 700 therefrom.

The invention claimed is:

1. An air conditioning management apparatus, comprising:

measured value acquisition means for obtaining a measured value of at least one of the state of air conditioning equipment and an air-conditioned state based on a set object to be measured and a measurement method;

target value setting means for obtaining and setting a target value of a degree of energy saving through a network or by an input of a user;

equipment control means for determining a control method of the air conditioning equipment for realizing energy saving based on the measured value and the target value and controlling the air conditioning equipment;

adding/changing means for the measured value acquisition means for obtaining and setting the object to be measured and the measurement method of the measured value acquisition means through the network;

adding/changing means for the equipment control means for adding or changing a determination method of an air conditioning equipment control method of the equipment control means, and a method of executing the control of the air conditioning equipment, through the network;

advice presentation means for presenting an advice for realizing energy saving to the user based on the measured value and the target value; and adding/changing means for the advice presentation means for adding or changing an advice contents creation method and an advice presentation method of the advice presentation means through the network or by an input of the user.

2. The air conditioning management apparatus of claim 1, further comprising:

selection means for selecting use of any one or both of the advice presentation means and the equipment control means based on the measured value and the target value.

3. The air conditioning management apparatus of claim 1, wherein the equipment control means controls a degree of thermo OFF to 0%-100%.

4. The air conditioning management apparatus of claim 1, wherein the equipment control means causes a thermo OFF control to be performed on an outdoor unit side.

5. The air conditioning management apparatus of claim 1, wherein the equipment control means operates at least one indoor unit and controls an outdoor unit so that it is not placed in a 100% thermo OFF state.

6. The air conditioning management apparatus of claim 1, wherein the equipment control means counts and stores the number of times of thermo ON/thermo OFF of an outdoor unit and performs a control so that warning is issued when the counted number of times exceeds a predetermined number of times.

7. The air conditioning management apparatus of claim 1, wherein:

the measured value acquisition means obtains a score coefficient; and the equipment control means stores the number of revolutions of a compressor in an operating state in which the score coefficient is increased and performs an operation control by setting the number of revolutions as an upper limit number of revolutions, wherein the score coefficient is equal to the refrigeration capability (kW) divided by the output (kW) of a motor for driving the compressor.

8. An air conditioning system, comprising:

at least one air conditioning management apparatus of claim 1; and at least one air conditioning equipment connected to the air conditioning management apparatus.

9. An air conditioning management apparatus, comprising:

measured value acquisition means for obtaining a measured value of at least one of the state of air conditioning equipment and an air-conditioned state based on a set object to be measured and a measurement method;

law/regulation information acquisition means for obtaining law/regulation information through a network to analyze the law/regulation information and extract a control target value;

equipment control means for determining a control method of the air conditioning equipment for realizing energy saving based on the measured value and the control target value and controlling the air conditioning equipment;

adding/changing means for the measured value acquisition means for obtaining and setting the object to be measured and the measurement method of the measured value acquisition means through the network; and adding/changing means for the equipment control means for adding or changing a determination method of an air conditioning equipment control method of the equipment control means, and a method of executing the control of the air conditioning equipment, through the network.

10. The air conditioning management apparatus of claim 9, further comprising:

advice presentation means for presenting an advice for realizing energy saving to the user, based on the measured value and the law/regulation information; and adding/changing means for the advice presentation means for adding or changing an advice contents creation method and an advice presentation method of the advice presentation means through the network or by an input of the user.

11. The air conditioning management apparatus of claim 10, further comprising:

selection means for selecting use of any one or both of the advice presentation means and the equipment control means based on the measured value and the law/regulation information.

12. The air conditioning management apparatus of claim 9, wherein the equipment control means controls a degree of thermo OFF to 0%-100%.

13. The air conditioning management apparatus of claim 9, wherein the equipment control means causes a thermo OFF control to be performed on an outdoor unit side.

14. The air conditioning management apparatus of claim 9, wherein the equipment control means operates at least one indoor unit and controls an outdoor unit so that it is not placed in a 100% thermo OFF state.

15. The air conditioning management apparatus of claim 9, wherein the equipment control means counts and stores the number of times of thermo ON/thermo OFF of an outdoor unit and performs a control so that warning is issued when the counted number of times exceeds a predetermined number of times.

16. The air conditioning management apparatus of claim 9, wherein:

the measured value acquisition means obtains a score coefficient; and the equipment control means stores the number of revolutions of a compressor in an operating state in which the score coefficient is increased and performs an operation control by setting the number of revolutions as an upper limit number of revolutions, wherein the score coefficient is equal to the refrigeration capability (kW) divided by the output (kW) of a motor for driving the compressor.

17. An air conditioning system, comprising:

at least one air conditioning management apparatus claim 9; and at least one air conditioning equipment connected to the air conditioning management apparatus.

* * * * *